US006578838B2

(12) United States Patent
Trovinger et al.

(10) Patent No.: US 6,578,838 B2
(45) Date of Patent: Jun. 17, 2003

(54) SHEET COLLECTING APPARATUS WITH INTEGRATED STAPLE MECHANISM

(75) Inventors: Steven W Trovinger, Los Altos, CA (US); Ross R. Allen, Belmont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 89 days.

(21) Appl. No.: 09/820,741

(22) Filed: Mar. 30, 2001

(65) Prior Publication Data

US 2002/0140153 A1 Oct. 3, 2002

(51) Int. Cl.[7] ..... B42C 19/04

(52) U.S. Cl. ..... 270/52.18; 270/58.08; 227/155; 227/101; 493/384

(58) Field of Search ..... 270/58.07, 58.08, 270/52.18, 58.13; 227/41, 101, 154, 155; 493/384

(56) References Cited

U.S. PATENT DOCUMENTS

| | | | | | |
|---|---|---|---|---|---|
| 2,334,265 | A | * | 11/1943 | Hildmann | 112/21 |
| 2,895,730 | A | * | 7/1959 | Biel et al. | 270/37 |
| 3,492,955 | A | * | 2/1970 | Gallagher | 112/21 |
| 3,601,388 | A | * | 8/1971 | Hilliard et al. | 270/52.28 |
| 3,797,419 | A | * | 3/1974 | Depetris | 112/21 |
| 3,806,111 | A | * | 4/1974 | Lachman et al. | 270/52.28 |
| 4,196,835 | A | * | 4/1980 | Schlough | 227/81 |
| 4,221,373 | A | | 9/1980 | Muller Hans | |
| 4,236,706 | A | * | 12/1980 | Schlough | 270/52.18 |
| 4,484,501 | A | | 11/1984 | Ramcke | |
| 4,522,383 | A | * | 6/1985 | Macey | 227/101 |
| 4,575,296 | A | | 3/1986 | Kockler et al. | |
| 4,595,187 | A | | 6/1986 | Bober | |
| 4,614,290 | A | * | 9/1986 | Boss | 227/1 |
| 4,641,825 | A | * | 2/1987 | Mowry et al. | 270/52.26 |
| 4,795,071 | A | | 1/1989 | Jacobs et al. | |
| 5,028,193 | A | | 7/1991 | Misicka | |
| 5,100,118 | A | * | 3/1992 | Hobbs et al. | 270/52.17 |
| 5,174,557 | A | * | 12/1992 | Meier | 270/37 |
| 5,377,965 | A | | 1/1995 | Mandel et al. | |
| 5,632,587 | A | | 5/1997 | Coyette | |
| 5,662,318 | A | | 9/1997 | Harada et al. | |
| 5,803,891 | A | | 9/1998 | Haan et al. | |
| 6,099,225 | A | | 8/2000 | Allen et al. | |

FOREIGN PATENT DOCUMENTS

| | | |
|---|---|---|
| WO | WO 0018583 | 4/2000 |

* cited by examiner

*Primary Examiner*—Patrick H. Mackey

(57) ABSTRACT

A sheet collecting apparatus in a sheet-wise booklet making system is provided, including a collecting device for supporting folded sheets of material in a stack arranged for stapling, and a stapling device for stapling the folded sheets of material supported by the collecting device. The collecting device and the stapling device are attached to a movable frame such that the stapling device remains aligned with the collecting device during movement of the movable frame.

21 Claims, 2 Drawing Sheets

SHEET COLLECTING APPARATUS WITH INTEGRATED STAPLE MECHANISM

BACKGROUND OF THE INVENTION

1. Field of the Invention

The present invention generally relates to finishing printed sheets of paper and, more particularly, to stapling and collecting printed sheets of paper.

2. Background Information

A system for finishing printed sheets into booklets is described in U.S. Pat. No. 6,099,225 (Allen et al., hereafter referred to as "the Allen patent"), hereby incorporated by reference in its entirety, where most finishing operations are performed on a sheet-by-sheet basis using precise paper positioning. The system also uses a transverse tool carrier for cutting, scoring, folding, punching, and stapling booklet sheets. Also described in the Allen patent is an inverted V-shaped workpiece for collecting folded booklet sheets. However, no specific method for aligning a stapler to the V-shaped workpiece is disclosed in the Allen patent.

Another system for making saddle-stitched booklets on a sheet-wise basis is disclosed in PCT No. WO 00/18583 (Trovinger et al., hereafter referred to as "the Trovinger PCT"), hereby incorporated by reference in its entirety. In this system, individual folded booklet sheets are forwarded from a folding device to a reciprocating saddle. This operation begins with the saddle at a first position, where an individual folded sheet is initially advanced (e.g., by rollers) from an upstream, folding device to the saddle, such that the leading side of the sheet is positioned to rest on the front side of the saddle, while the trailing side of the sheet remains supported or under the control of the upstream device.

As the leading side is advanced to the point where the fold of the folded sheet rests on the top edge of the saddle, the saddle is moved along rails towards a second position. Due to the movement of the saddle, the trailing side of the sheet is naturally released or cleared from the upstream device and falls toward the back side of the saddle. When the saddle reaches the second position, the transfer of the folded sheet from the upstream device to the saddle is complete, with the fold and the trailing side resting on the top edge and the back side of the saddle, respectively.

The above steps are repeated until a required number of booklet sheets have been collected on the saddle. The sheets are then stapled together on the saddle, where a stapler carriage is moved and operated as a unit separate from the saddle. In other words, the stapler carriage and its attached stapler head unit travel along stapler guide rails lying on one axis, while the saddle and its attached clinch portions moves along saddle guide rails lying in another axis. The saddle moves independently of the stapler guide rails, thereby allowing the distance between the saddle and the stapler carriage to change in the two axes while the saddle travels between the first and second positions.

Due to the independent movement of the stapler head unit and the saddle in the Trovinger PCT, accurate alignment between the two is difficult. Alignment of these device is important to insure properly formed staples, and such alignment may need to be within ±0.1 mm, depending on, for example, the stapler design and manufacture. Errors relating to alignment can be due to tolerance stack-up errors, normal mechanical clearances, excessive deflection, as well as servo or motion errors.

Some commercial booklet making devices attempt to address stapler alignment with the use of two fixed-position, pass-through staple units, where no relative movement occurs between a sheet collecting device and the staple units. The method of using fixed-position staple units can not, however, be easily used for sheet-wise operations. Multiple fixed-position staple units also increase a cost of a booklet making device.

Accordingly, it would be desirable to provide a sheet collecting system for sheet-wise operations for providing proper alignment between stapling and collecting portions.

SUMMARY OF THE INVENTION

The present invention is directed to a sheet collecting apparatus where a sheet collecting device and a stapler are combined into one unit, thereby eliminating misalignment between the two devices.

According to an exemplary embodiment of the present invention, a sheet collecting apparatus in a sheet-wise booklet making system is provided, comprising a collecting device for supporting folded sheets of material in a stack arranged for stapling, and a stapling device for stapling the folded sheets of material supported by the collecting device. The collecting device and the stapling device are attached to a movable frame such that the stapling device remains aligned with the collecting device during movement of the movable frame.

According to another embodiment of the present invention, a method for stapling a booklet comprises the steps of providing a collecting device and a stapling device both mounted on a movable frame, delivering a booklet sheet, and stapling a folded edge of the booklet sheet with the stapling device when the movable frame is at a second position, wherein the stapling device and the collecting device remain aligned while the movable frame is moved between a first position and the second position.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1:
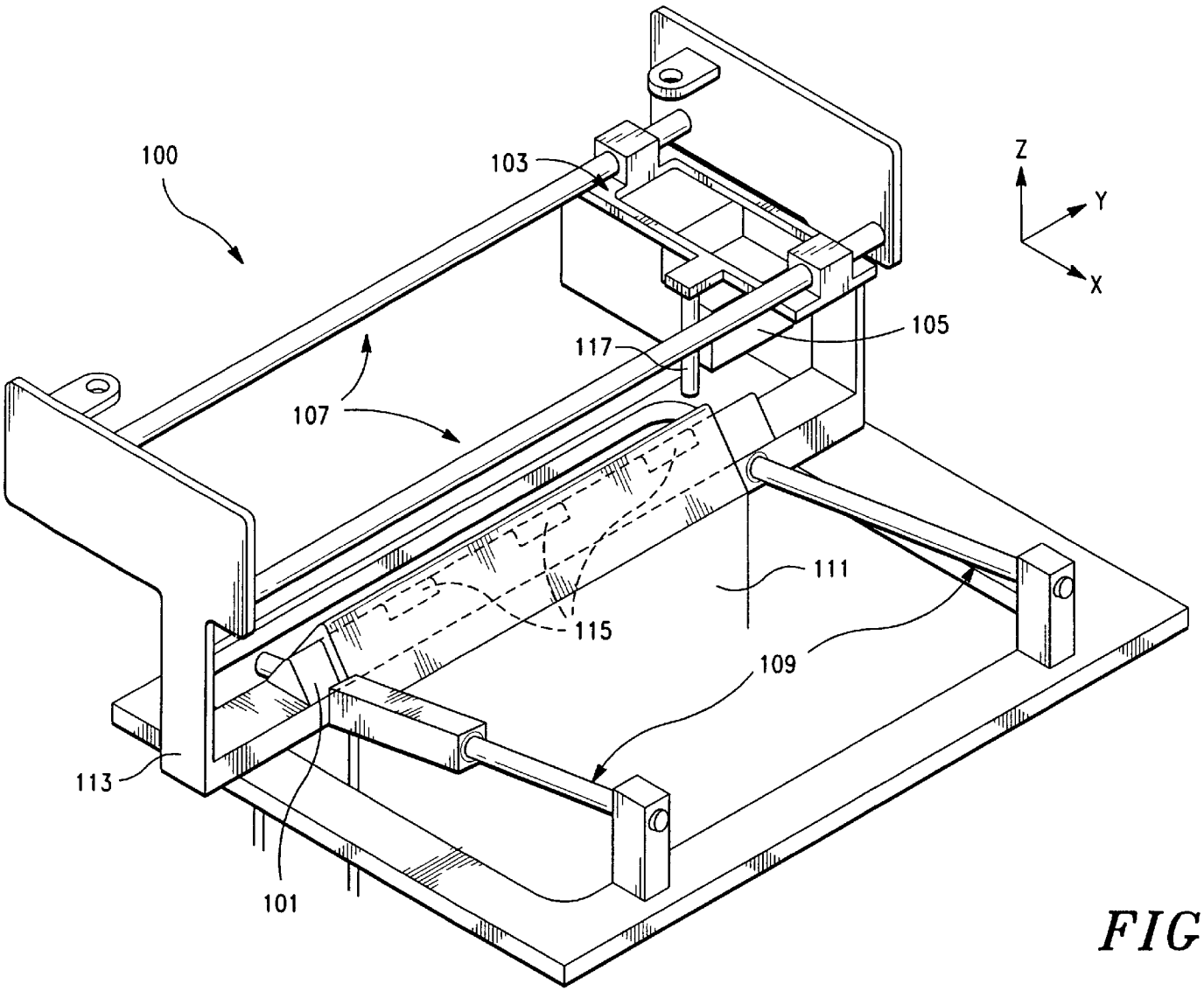
FIG. 1 is a perspective view of a combined saddle and stapler unit with the saddle in a first position for sheet collection in accordance with an embodiment of the present invention.

FIG. 1 illustrates a combined saddle and stapler unit 100 for use in a sheet-wise booklet making system. Unit 100 includes a movable frame 113, to which a saddle 101 and stapler guide rails 107 are attached. Saddle 101 acts as a collecting device for supporting collected folded sheets 111 on a first (e.g., top) edge and is arranged in the y-axis. Although shown as an inverted V-shaped member, the collecting device represented by saddle 101 can be formed in any desired shape. Stapler guide rails 107 are fixedly attached to frame 113, and saddle 101 can be fixedly mounted to frame 113 or can be alternatively mounted to frame 113 in such a way that it can move on frame 113 (e.g., pivot about an axis on frame 113). For example, saddle 101 and the portion of frame 113 upon which it is shown to be mounted in the exemplary FIG. 1 embodiment can be formed as an independent structure (i.e., independent of the remaining portions of frame 113), and pivotably mounted to rotate about the y-axis with respect to frame 113 (as shown in FIG. 1). Ends of the unitary structure that includes saddle 101 can, for example, be disposed within rotary bearings recessed within portions of the frame 113 which extend in the z-axis direction of FIG. 1.

Saddle 101 also includes one or more anvil or clinch portions 115, which operate in conjunction with a staple head unit 105 to create folded staples. Staple head unit 105 can be of conventional or any other construction. Clinch portions 115 are arranged on saddle 101 to be aligned with stapler head unit 105 in locations along the folded edges where the collected sheets 111 are to be stapled. Clinch portions 115 can be active or passive clinch mechanisms as known in the art. Stapler carriage 103 and stapler head unit 105 operate in combination as a stapling device to staple, in conjunction with clinch portions 115 of saddle 101, the folded sheets 111 supported by saddle 101.

Frame 113 is reciprocated on guide rails 109 in the x- and z-axes by, for example, a motor and any associated drive. For example, one or both of the guide rails 109 can be configured as motor-driven worm screws which, upon rotation, result in translation of frame 113 along the length of these rails. In this case, the motor can, for example, be housed within the saddle 101 or at any desired location. Of course, other types of motors, such as linear, hydraulic, pneumatic, or nay type of actuator, can be used for translation of frame 113.

Because stapler carriage 103 and stapler head unit 105 travel in the y-axis on guide rails 107, which are fixedly attached to frame 113 and saddle 101, both stapler carriage 103 and stapler head unit 105 move with frame 113 as it is reciprocated. In this way, the distance between stapler head unit 105 and any point on saddle 101 in the x- and z-axes remains constant, regardless of where frame 113 is positioned along guide rails 109. Only along the y-axis (where folded edges of sheets 111 lie on saddle 101) can the distance between stapler head unit 105 and any point on saddle 101 change with the movement of stapler carriage 103 along guide rails 107. Consequently, the use of frame 113 eliminates the chance for misalignment between stapler head unit 105 and saddle 101 in the x- and z-axes.

Figure 2:
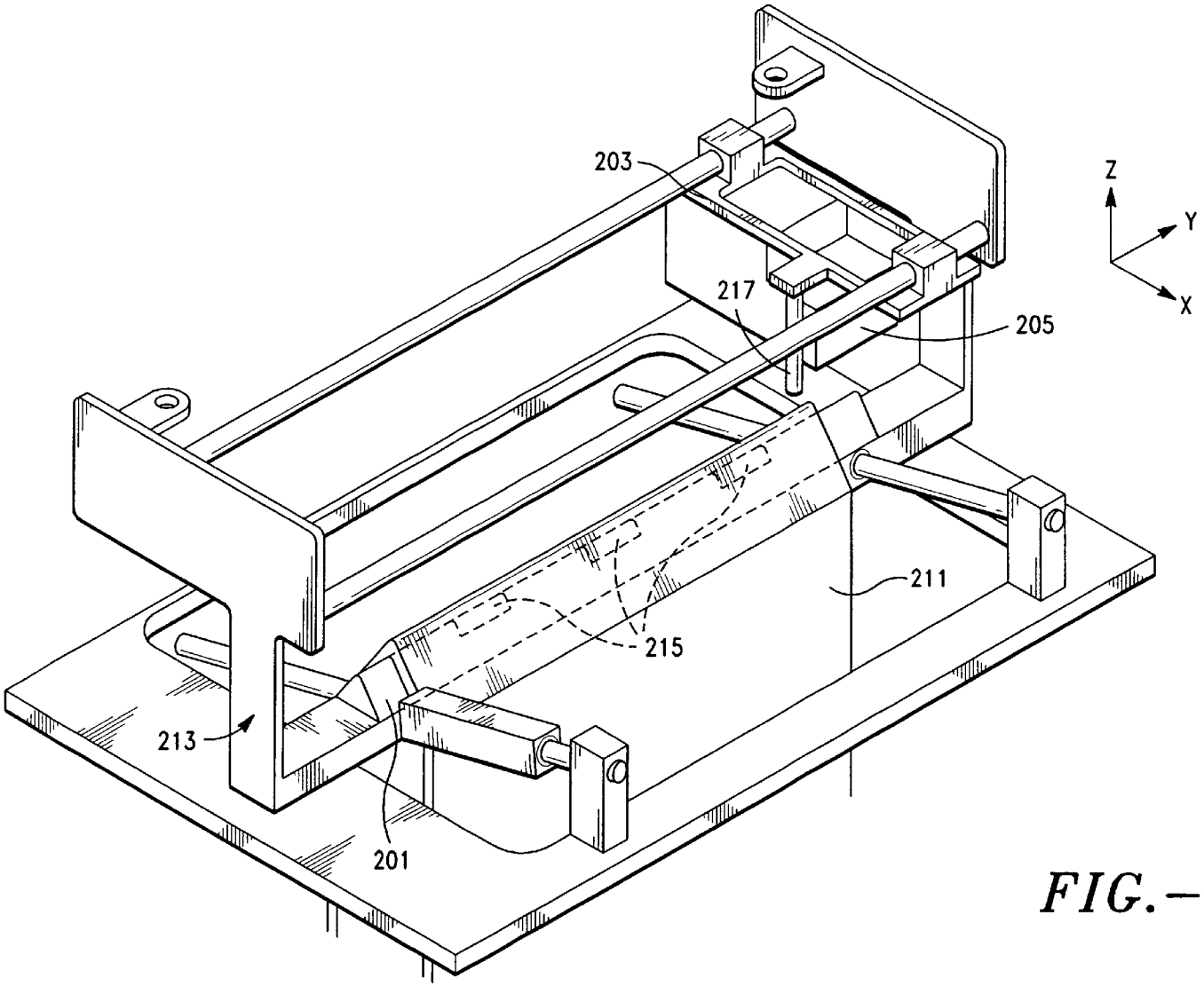
FIG. 2 is a perspective view of the combined saddle and stapler unit of FIG. 1 with the saddle in a second position for sheet collection.

During a sheet collection operation, frame 113 is reciprocated between a first (e.g., forward or starting) position shown in FIG. 1, and a second (e.g., rearward or end) position shown in FIG. 2. In the forward position, the process of delivering or "handing-off" an individual folded sheet to the stack of collected folded sheets 111 on saddle 101 is begun. Such delivery can be from an upstream folding or punching device, for example. The transfer of an individual folded sheet to saddle 101 at the forward position is only partial and not yet complete; that is, in this position, a portion of the folded sheet is delivered to saddle 101, while another portion (e.g., a trailing side) of the folded sheet remains supported or controlled by an upstream device and is not received by saddle 101.

As frame 113 moves from the forward position to the rearward position, the trailing edge of the folded sheet clears the upstream device and falls to one side of saddle 101. In this way, saddle 101 can completely receive the folded sheet. By the time frame 113 arrives at the second position, the folded sheet is supported by saddle 101, with the folded edge of the folded sheet resting on the top edge of saddle 101. Frame 113 is then moved back to the first position to allow saddle 101 to begin receiving another folded sheet. By reciprocating between the forward and rearward positions, individual folded sheets are delivered to and collected on saddle 101 on a sheet-wise basis (i.e., one individual sheet at a time) until a predetermined number of sheets is collected on saddle 101.

FIG. 2 illustrates movable frame 213 positioned in a rearward or second position for sheet collection, where the transfer of an individual folded sheet is completed. As seen in the figure, the folded edges of the sheets are positioned in the collected sheet stack 211 to rest on the top edge of saddle 201. As frame 213 reciprocates between the forward position to the rearward position, saddle 201, stapler carriage 203, and stapler head unit 205 move along with it. When frame 213 is located at the rearward position, stapler carriage 203 and stapler head unit 205 can operate in conjunction with clinch portions 215 to staple the folded edges of collected sheets 211 together to form a complete booklet. The stapling operation can occur when, for example, the quantity of collected folded sheets 211 equals a predetermined number of sheets (e.g., a number required to form a complete booklet or when any desired condition exists). The booklet can, of course, have any number of staples resulting from the stapling process binding it together.

Before a stapling operation, stapler carriage 203 can be configured to optionally align collected sheets 211 along the x-axis and/or y-axis by performing a squaring-up operation, as described in the Trovinger PCT. For example, a stack justify pin 217 attached to and extending from the stapler carriage 203, and thus moveable relative to the collected sheets, can be used to forcibly align the collected sheets after they have been accumulated on saddle 201. Alternatively, this alignment step can be performed by a device separate from stapler carriage 203 which operates in similar fashion to square-up edges.

By combining the structure of a collecting device (e.g., saddle 101, 201) with the structure supporting a stapler device (stapler carriage 103, 203 and stapler head unit 105, 205) to form a single, movable unit, misalignment relating to the stapling of folded edges of collected folded sheets is eliminated. It is apparent to those skilled in the art that folded sheets can be delivered to collecting device 101, 102 and subsequently removed from collecting device 101, 102 in any manner known in the art.

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A sheet collecting apparatus in a sheet-wise booklet making system, comprising:

a collecting device for receiving plural folded sheets of material on a sheetwise basis and for supporting folded sheets of material in a stack arranged for stapling; and a stapling device for stapling the folded sheets of material supported by the collecting device, the stapling device translatably mounted for positioning the stapling device with respect to each of a plurality of staple positions on the collecting device, wherein the collecting device and the stapling device are attached to a movable frame such that the stapling device remains aligned with the collecting device during movement of the movable frame.

2. The apparatus of claim 1, wherein the movable frame is reciprocated between a first position and a second position.

3. The apparatus of claim 2, wherein the collecting device partially receives an individual folded sheet when the movable frame is located at the first position.

4. The apparatus of claim 3, wherein the collecting device completely receives the folded sheet as the movable frame is moved to the second position.

5. The apparatus of claim 2, wherein the stapling device staples the folded sheets when the movable frame is located at the second position and when a predetermined number of individual sheets have been received by the collecting device.

6. The apparatus of claim 1, wherein the stapling device includes at least one stapler head unit and wherein the collecting device includes at least one clinch portion aligned with the at least one stapler head unit.

7. The apparatus of claim 1, wherein the stapling device staples the folded edges of the folded sheets together to form a booklet.

8. The apparatus of claim 1, wherein the collecting device is V-shaped.

9. The apparatus of claim 1, wherein the collecting device is fixedly attached to the movable frame.

10. The apparatus of claim 1, wherein the stapling device aligns folded sheets on the collecting device.

11. A method for stapling a booklet, comprising the steps of:

providing a collecting device and a stapling device both mounted on a movable frame;

delivering a booklet sheet; and stapling a folded edge of the booklet sheet with the stapling device when the movable frame is at a second position, wherein the stapling device and the collecting device remain aligned while the movable frame is moved between a first position and the second position, and wherein the stapling device is translatable relative to the collecting device to a plurality of staple positions on the collecting device.

12. The method of claim 11, wherein the step of delivering comprises the steps of:

locating the movable frame at the first position;

transferring a leading edge of a first folded sheet to the collecting device; and moving the movable frame to the second position, such that the collecting device can receive a trailing edge of the first folded sheet.

13. The method of claim 12, wherein the step of delivering comprises the step of:

repeating the steps of locating, transferring, and moving until a predetermined number of booklet sheets are delivered to the collecting device.

14. The method of claim 11, wherein folded edges of the booklet sheets are stapled together with the stapling device when a predetermined number of booklet sheets are delivered to the collecting device.

15. The method of claim 11, wherein the collecting device is substantially arranged in a first axis and the stapling device is movable along the first axis.

16. The method of claim 11, wherein the collecting device is V-shaped.

17. The method of claim 13, comprising the step of:

aligning the booklet sheets on the collecting device.

18. The apparatus of claim 1, wherein the stapling device is translatable relative to the collecting device.

19. The apparatus of claim 18, wherein the stapling device is translatable, relative to the collecting device, to a plurality of staple positions.

20. A method for stapling a booklet, comprising the steps of:

providing a collecting device and a stapling device both mounted on a movable frame;

delivering a booklet sheet, wherein the step of delivering comprises the steps of locating the movable frame at a first position, transferring a leading edge of a first folded sheet to the collecting device, moving the movable frame to the second position, such that the collecting device can receive a trailing edge of the first folded sheet, and repeating the steps of locating, transferring, and moving until a predetermined number of booklet sheets are delivered to the collecting device; and stapling a folded edge of the booklet sheet with the stapling device when the movable frame is at a second position, wherein the stapling device and the collecting device remain aligned while the movable frame is moved between the first position and the second position.

21. The method of claim 20, comprising the step of aligning the booklet sheets on the collecting device.

* * * * *